United States Patent [19]

Hogg

[11] Patent Number: 4,485,995

[45] Date of Patent: Dec. 4, 1984

[54] SPRING-BIASED WALL HANGER

[76] Inventor: James W. Hogg, 6216 Hillsboro Rd., Nashville, Tenn. 37315

[21] Appl. No.: 393,550

[22] Filed: Jun. 30, 1982

Related U.S. Application Data

[63] Continuation-in-part of Ser. No. 268,499, May 29, 1981, Pat. No. 4,422,608.

[51] Int. Cl.[3] ..... E04G 5/06

[52] U.S. Cl. ..... 248/218.1; 248/222.2

[58] Field of Search ..... 248/218.1, 216.1, 218.3, 248/217.2, 221.1, 221.2, 222.2, 225.2, 225.1, 218.2, 216.4, 467

[56] References Cited

U.S. PATENT DOCUMENTS

| | | | |
|---|---|---|---|
| 2,312,985 | 3/1943 | Bales | 248/221.2 |
| 2,961,724 | 11/1960 | Alling | 248/221.2 |
| 3,193,225 | 7/1965 | Terlinde | 248/221.2 |
| 3,315,816 | 4/1967 | Mallory | 248/225.1 |
| 3,477,677 | 11/1969 | Hindley | 248/220.3 |
| 3,879,006 | 4/1975 | Staudte | 248/221.2 |
| 4,105,179 | 8/1978 | Elliot | 248/221.2 |
| 4,325,528 | 4/1982 | Martin | 248/217.2 |

FOREIGN PATENT DOCUMENTS

| | | | |
|---|---|---|---|
| 37392 | 7/1923 | Norway | 248/217.2 |
| 15923 | 7/1906 | Switzerland | 248/217.2 |

*Primary Examiner*—William H. Schultz
*Assistant Examiner*—Ramon O. Ramirez
*Attorney, Agent, or Firm*—Fisher, Christen & Sabol

[57] ABSTRACT

A wall hanger which penetrates into wallboard, wood, or paneling has a pointed penetrating end formed of a resiliently deformable wire which is attached to a plate member having a hook integral therewith. A base of the wire is fixedly attached to the plate member near the hook. In an undeformed condition, the penetrating end is closer to the back of the support than the thickness of the wall, and a portion of the wire is spaced in front of the support member.

Upon insertion into a wall, the penetrating end is biased against the back of the wall due to resiliency of the wire, since the portion of wire previously spaced from in front of the support member is deformed toward the support member to accommodate the wall thickness.

28 Claims, 22 Drawing Figures

FIG. 1
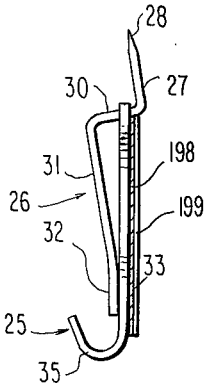
FIG. 2
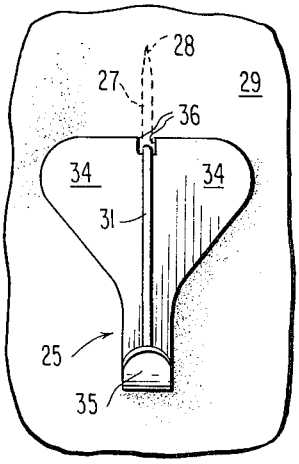
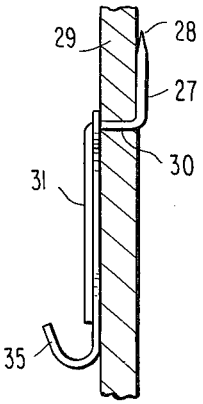
FIG. 3
FIG. 4
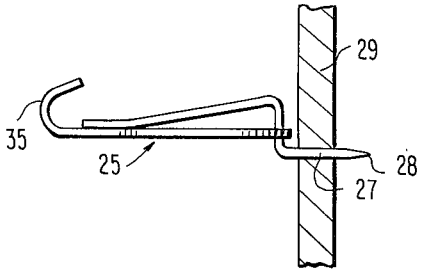
FIG. 5
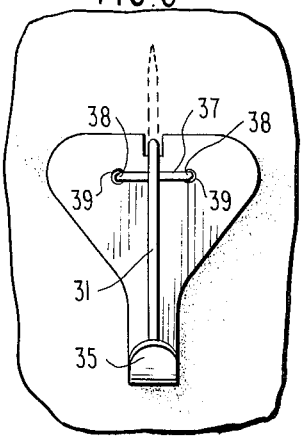
FIG. 6
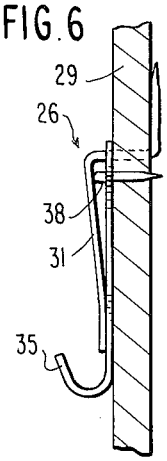
FIG. 7
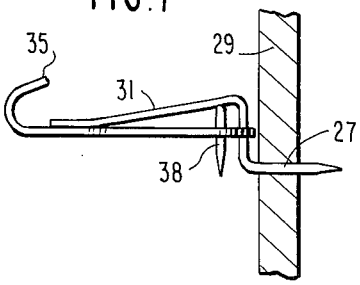
FIG. 8
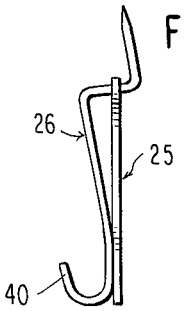
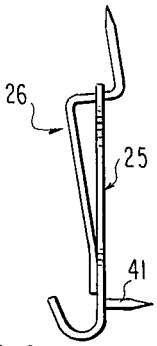
FIG. 9
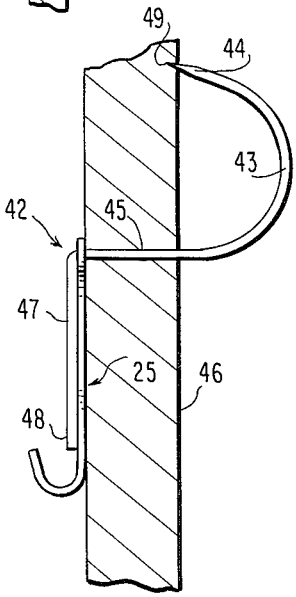
FIG. 10
FIG. 11
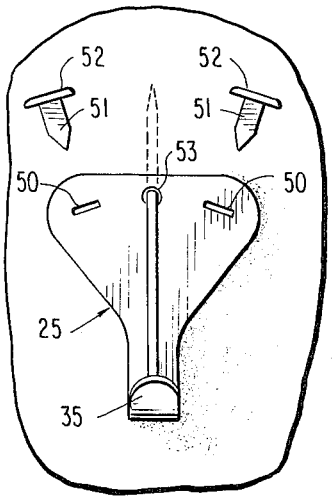

SPRING-BIASED WALL HANGER

CROSS-REFERENCE TO ANOTHER APPLICATION

This application is a continuation-in-part of my copending application Ser. No. 268,499, filed May 29, 1981, now U.S. Pat. No. 4,422,608.

BACKGROUND OF THE INVENTION

This invention relates to a wall hanger for supporting articles such as pictures, or plaques, on a vertical panel, or wall, and more particularly to the type of hanger for use in connection with relatively thin panels of wallboard, gypsum or plywood panelling, the latter being frequently used in the construction of hollow wall doors, or interior panelling of rooms.

Hangers of this type usually include a wire rod, or fastener having an upwardly projecting end which terminates in a sharp point to allow the wire to be initially forced through a panel from the front side so as to penetrate the panel completely and thereby provide a generally horizontal passage. A succeeding portion of the wire, generally disposed at right angles to the initial penetrating portion is then pushed into the passage to provide support for the hanger to prevent vertical displacement while the penetrating portion thereafter projects upwardly behind the panel to assist in preventing said displacement and prevent the hanger from being pulled directly outwardly away from the panel.

While the penetrating tip may be smoothly tapered, the tip portion may have one, or more, flat sides, or may be threaded, to assist in the initial penetration. This general type of hanger is disclosed in U.S. Pat. No. 2,789,783. While the wire fastener is usually provided with a penetrating tip to allow it to be forcibly inserted into a panel, it is obvious that hangers of this type can be used where the passage in the wall already exists, as in the case of the hangers disclosed in U.S. Pat. Nos. 1,445,372 and 3,219,302.

SUMMARY OF THE INVENTION

It occasionally happens that because of an irregularity in the rear surface of a wall panel, such as a depression resulting from gouging during handling, that the penetrating end of the fastener does not lie in contact with the rear surface after the hanger has been inserted. The result will be that the hanger will not be held flush against the front of the panel and continual jarring, or vibration of the suspended object will ultimately enlarge the opening. These imperfections, obviously cannot be observed from the front of the panel but the result may be that another location must be chosen, while the initial opening in the panel remains.

A similar result, namely a loosely attached hanger, will result if the thickness of the panel is materially less than that standard thickness for which the hanger is designed, or if for some reason the fastener member has become distorted from its correct shape either before, or during, installation of the hanger.

At the other extreme, if the panel is of unexpected thickness, or some excess material has adhered to the back of the panel where the hanger is to be located, it may turn out that the length of the horizontal section of the fastener is too short to allow the penetrating section to be properly seated against the back of the panel.

It is therefore an object of the present invention to overcome any difficulties due to variations in the thickness of a panel by making the load-supporting section of the fastener wire, or rod, with a length sufficient to accomodate reasonable variations in panel thickness and to attach the fastener wire to the front plate in such a way that, by flexure of a section of the wire, the penetrating section will always be in contact with the rear side of the panel and will exert sufficient pressure on the plate to maintain it flush against the panel's front surface.

Another object of the invention is to provide a wall hanger of the type wherein a plate is to be placed flush against the front wall of a panel and held in place primarily by a wire fastener rod which extends through to the back side of the panel, in which the fastener rod, or wire, is separable from the plate when not in use to allow the two elements to be packed in a flat package for shipping.

Still another object of the invention is to provide a wall hanger of the type having a fastener wire, or rod, which is separable from the wall plate wherein the end of the wire, or rod, remote from the penetrating end is adapted to be received within an opening in the plate for pivotal movement between an attached and a detached position when not in use, and clip means is included for securing the wire, or rod, in operative position.

Yet another object of the invention is to provide a wall hanger of the type wherein the portion of the fastener rod, or wire, may be flexed in use to press the plate member into close contact with the wall when in use but which permit the fastener wire, or rod, to be detached from the plate when not in use.

Other objects and advantages will be apparent to those skilled in the art after reading the following specification in connection with the annexed drawings.

BRIEF DESCRIPTION OF THE DRAWING

FIG. 1 is a side elevation, from the right, of a preferred form of spring-biased wall hanger according to the present invention;

FIG. 2 is a front elevation of the hanger when positioned on a wall;

FIG. 3 is a side elevation taken through a section of a wall showing the hanger in place;

FIG. 4 is a view similar to that of FIG. 3, showing a step in insertion of the penetrating end of the wire rod member;

FIG. 5 is a front elevation of a modified form of spring-biased wall hanger;

FIG. 6 is a side elevation of the hanger of FIG. 5;

FIG. 7 is a view similar to FIG. 4 showing insertion of the wire rod of FIG. 6 into a wall;

FIGS. 8, 9, 10 and 11 are additional modified forms of the invention;

DETAILED DESCRIPTION OF THE INVENTION

Figure 12:
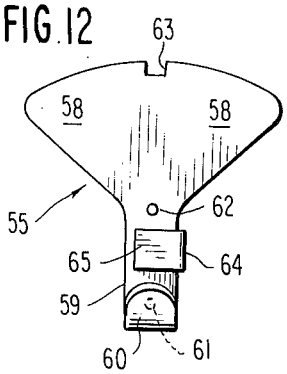
FIG. 12 is a front elevation of a modified form of supporting member for a wall hanger according to this invention.

Referring now to FIGS. 1–4, which illustrates a preferred form of wall hanger to be used on hollow wall doors and plywood panelling, in which there is shown a plate member, indicated generally by numeral 25, and a wire fastening rod member, indicated generally by numeral 26, made of a flexible material wuch as spring steel. One end section 27 of the rod terminates in a sharply pointed section 28 for use in initially penetrating a wall 29 to which the hanger is to be applied. The end section 28 may be smoothly tapered, may be provided with one or more lengthwise flat sides, or be provided with a threaded auger-type surface to aid in the penetration of the wall.

The upwardly directed penetrating end 27 is joined to a medial section 30 disposed at right angles so as to extend horizontally through the opening formed in the wall by insertion of the penetrating rod. The wire rod also includes an attaching section 31, extending generally at right angles downwardly away from the medial section 30 and is secured at its lower end 32 to the front of the plate by suitable means, such as, soldering or welding 33. The wire rod 26 should be attached to the plate 25 in such a way that initially the section 31 will extend upwardly and angularly away from the front face of plate 25. This can be accomplished by either bending section 32 with respection to section 31, or by providing the rear side of section 32 with a downwardly and forwardly angled flat surface.

The shape of the plate 25 is not critical although a preferred form is generally butterfly-shaped, with the upper portion having outward extending wing portions 34 merging into a central depending portion terminating in an outwardly and upwardly directed load-supporting element, such as a hook 35. The upper margin may have a downwardly directed slot or hole 36, through which the medial portion 30, of the wire rod passes for the purpose of preventing sidewise displacement of the plate when in place. To increase the stability, and load-carrying capacity of the hanger the rear surface of the plate may also be provided with an adhesive layer 198 (having a greatly exaggerated thickness) provided with a protective removable layer 199, shown in FIG. 1.

As can be seen in FIG. 1, the fastening rod 26 is secured to plate 25 in such a way that in its normal, unstressed condition the section 31 extends upwardly and outwardly away from the front of the plate 25. When it is desired to attach the holder to a wall, which may be a plywood panel or hollow wall door panel approximately ¼ inch thick, the pointed end 28 is forcibly pushed through or screwed into the panel 29 in a horizontal direction, as shown in FIG. 4. Although an adhesive layer may optionally be included as shown in FIG. 1, no adhesive layer is shown in any of the remaining figures.

After the pointed end has penetrated completely through the movement is continued in the same direction until the junction between sections 27 and 30 abuts against the front surface of the wall, at which point the holder, as a whole including the plate 25 and rod 26, are turned downwardly while pressure is applied at the point where section 30 meets the springy section 31 to force the medial section 30 into the horizontal passage created by the penetration of the initial section 27. Finally, when the plate 25 lies flush against the wall, as seen in FIG. 3, the spring section 31 will lie close to the plate while the section 27 will lie against the back surface of the wall in a vertical position. Thus, as long as the holder remains in this position the portion 31 of the rod will be locked in a flexed condition to hold the plate 25 against the wall and also resist downward displacement while the medial section 30 will additionally prevent any vertical displacement of the hook 35, attached to plate 25. While the fixed connection 33 between rod section 31 and plate 25 limits the possibility of twisting of the plate with respect to the rod, the fact that the medial section 30 passes through slot 36 positively prevents any such twisting.

The form of the invention shown in FIGS. 5–7 is similar to the form already described except the means is also provided to supply additional vertical load-carrying capacity to the holder while, at the same time eliminating the possibility of the plate swinging about the fulcrum defined by the opening in the wall through which the horizontal rod portion 30 passes. This restricting means comprises a generally U-shaped transverse arm 37, made of stiff metal wire, or stiff metal strip material, the two legs 38 of which are sharply pointed at their respective ends. The arm 37 is attached to the springy portion 31 of the fastening rod by soldering, or welding, so as to line in a horizontal plane with the legs 38 in alignment with a pair of apertures 39 provided in plate 25.

As with the previously described form, the holder is installed by first forcing the penetrating portion 27 of the rod through a wall panel 29 in a horizontal direction, as shown in FIG. 7 and, while turning the assembly downwardly while applying force on the portion 31, the end portions 38 of the transverse arm will enter the wall, so that in its final position, as shown in FIG. 6, the plate will be vertically supported by the projecting ends 38 of the arm as well as the rod portion and portion 27 pressing against the back of the wall while, in addition, the entrance of the ends 38 will prevent any swinging movement of the plate 25 about the pivot provided by section 30.

In the form shown in FIG. 8 the plate 25 does not include the upturned hook portion 35, as in the previous designs. Instead, the lower end of the springy portion 31 of the fastener rod is extended beyond the location 32 where it is joined to the plate and is turned upwardly in a reentrantly curved path to form the hook 40 which serves to support a load. In all other respects this form of hanger is similar to those previously described.

In FIG. 9 there is shown another way in which downward displacement and swinging movement of the plate 25 may be avoided. In this case the plate has firmly attached to its back side a short length of stiff wire having a pointed end which serves as a wall-penetrating spike 41 extending backwardly perpendicular to the plate 25. While maximum load-bearing capacity is obtained when the spike extends entirely through the wall it need not be long enough to pass completely through a wall; it is only necessary that it enter a sufficient distance to anchor plate 25 against swinging movement and furnish the desired amount of additional resistance to vertical displacement. It may be noted that even though the presence of the penetrating arms 38 in the modification shown in FIGS. 5–7 limits swinging movement, the addition of spike 41 would not be precluded.

The modification shown in FIG. 10 is for use with wall panel, such as gypsum or "wallboard" having thicknesses substantially greater than the usual plywood paneling. In this modification the flat plate 25 is provided with a fastener rod 42, made of a springy metal having one end portion 43 arcuately formed with a radius of curvature on the order of about one inch, more or less, and terminating in a sharpened point 44 similar to the termination 28 of the previously described fastener rod 26. The arcuate portion 43 then merges with a more or less straight portion 45 which will be disposed generally horizontally in the opening made in the wall 46 resulting from forcible penetration of the wall by the arcuate portion as seen in FIG. 10. A downwardly depending portion 47 extends generally at right angles to the medial portion 45 and is soldered, or welded or otherwise secured at its layer end 48 to a lower portion of plate 25.

The hanger shown in FIG. 10 is applied to a thick wall 46 by first holding it in an upside-down position with the pointed end 44 placed on the front of the wall at the desired location, after which force is applied against the curved portion 43, and possible rotational motion, to cause the end 44 to pass completely through the wall, after which the application of force may be transferred to the juncture between portions 45 and 47 to cause the end 44 to move upwardly and backwardly until it again contacts the rear side of the wall and may become slightly embedded therein, as at 49. It should be noted that the curvature and length of penetrating portion 43 should be such that when the plate 25 is flat against the front surface of wall 46, the pointed end 44 will, when in contact with the back side of wall 46, hold the springy portion 47 in a flexed condition to continue to exert pressure urging plate 25 in close contact with the wall. As the load increases the point 49 is forced deeper into the wall, resisting vertical displacement. It should also be noted that the fastening rod 42 can also be used in conjunction with any of the previously described embodiments when they are to be used to support an object, or article, on a relatively thick wall panel.

An arrangement for augmenting the load-supporting capacity of any of the hangers disclosed herein, but preferably for wallboard or gypsum, is illustrated in FIG. 11, in which the plate 25 is provided with a pair of slots 50 disposed on opposite sides of the vertical centerline of the plate 25, and generally at right angles to a line connecting the center of a respective slot and load-supporting hook 35. After the plate 25 has been firmly attached to a wall, by means of any of the fastener rods described, a flat metal prong 51, having an enlarged flat head 52, is forcibly thumb-pushed into the wall through each of the slots 50. As a result of the angular disposition of the slots 50, the prongs 51 will thus be able to more effectively resist possible displacement of plate 25 even if a downward force is being exerted on hook 25 in an angular direction with respect to the vertical. In a further version of this improvement, instead of being received in the upper marginal slot 36, the horizontal portion of the fastener rod may pass through an opening 53 placed near the upper margin.

Still another modification of the invention is disclosed in FIGS. 12–19, in which the wire fastener is a separate element to be attached to the support member only when the hanger is to be installed. Such an arrangement permits the two elements to be packaged together in a relatively thin flat package without the necessity for having to provide a protecting covering for the outwardly projecting penetrating end of the wire fastening member. In addition, when it happens that the location chosen is over a hidden stud in the wall the fastener member can be discarded and a nail can be driven through hole 62 into the wall and stud.

Figure 13:
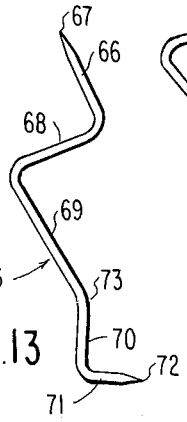
FIGS. 13 and 14 are side elevations of two forms of fastener rod for use with the supporting member of FIG. 12.
Figure 14:
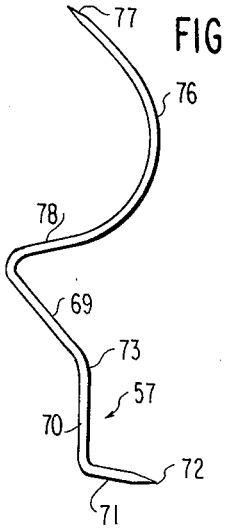

The support plate, indicated generally by numeral 55 is designed to be primarily attached to a wall by means of a separate fastener wire, or rod, typical examples of which are indicated generally by numerals 56 and 57 in FIGS. 13 and 14, the first being suitable for thin panels, while the latter is for use with thicker wall panels such as wallboard and gypsum board.

Preferably the configuration of the plate is generally similar to those previously described, wherein an upper portion may have outwardly extending wing portions 58 which narrow downwardly into a depending load-supporting portion 59 terminating in an upwardly and forwardly turned hook 60. A pair of apertures 61 and 62, and a downwardly indented marginal recess 63, all in vertical alignment are provided in the center of the plate for reasons which will be explained. An attaching means for a wire fastener rod is provided by the inclusion of an integrally formed tab portion 64 in one of the side margins of the depending portion 59. The extremity 65 of the tab is bent backwardly to lie in a plane generally parallel to, and spaced forwardly from, the front face of portion 59 to provide a fastener rod clip.

The fastening 56, in FIG. 13 is made preferably from a resilient material, such as spring steel, shaped to provide, in succession, a first penetrating portion 66, terminating in a sharp point 67 to be used to pierce a wall panel, a second portion 68 to be disposed generally horizontally in an opening in a wall panel and generally at right angles to the upwardly directed first portion; a third portion 69, lying generally at right angles to the second portion and extending downwardly across the front of the supporting plate 55, a fourth portion 70 extending further downwardly at a slight angle to portion 69. This fourth portion is to be held firmly against the face of plate 55 by the clip 65 so that portion 69 may be pushed toward the wall to press the plate against the wall. A fifth portion 71, extending backwardly, generally at right angles to the fourth portion, is intended to be received in the opening 61 in the plate to permit pivotal swinging of rod 56 as a whole. If desired this last portion may have a length sufficient to project at least a short distance backwardly from the plate, in which case it will also be provided with a sharply pointed end 72 to be embedded partially into, or entirely through, a wall to prevent swinging movement of the hanger and to add to its load-carrying capacity.

Figure 15:
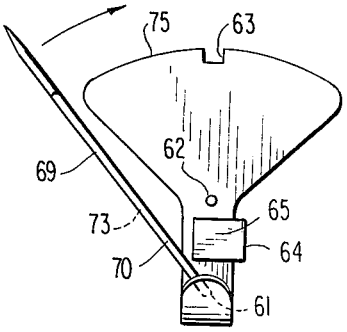
FIG. 15 is a front elevation showing the manner in which a fastener rod is secured to the hanger member of FIG. 12.
Figure 18:
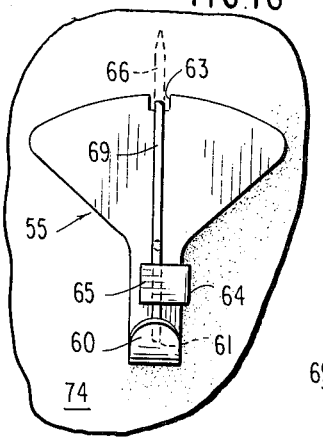
FIG. 18 is a front elevation of the hanger of FIG. 17.

To attach the fastener rod 56 to the plate 55 it is also necessary to first insert the end portion 71 into the opening 61, being careful to hold the rod in such a position that the attaching portion 70 will clear the end margin of clip 65, as shown in FIG. 15. The rod may then be pivoted about the opening 61 to the point where portion 70 will be frictionally held within the clip 65 and portion 68 will drop into recess 63 and is disposed to lie with the flexural portion extending across the center of the area defined by the wing portions 58, as seen in FIG. 18. While not essential to the operation of the wall hanger, the provision of the opening 62 in the plate serves a useful purpose in that it is located at a distance above the pivot opening 61 such that it acts as a detent to be engaged by the juncture 73 between the third and fourth portions 69 and 70 of the rod to hold the rod in its proper position. It will be appreciated that while this detent is described as being an "opening" in the plate, a slight depression in the front surface would also be sufficient to temporarily position the rod. As previously noted, if a hidden stud lies back of the wall, the plate may be held in place by a nail driven through hole 62.

Figure 16:
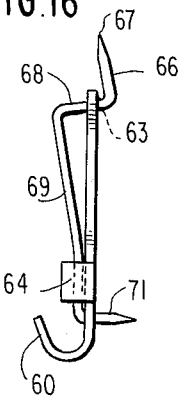
FIG. 16 is a side elevation, from the right, of the combination shown in FIG. 15.
Figure 17:
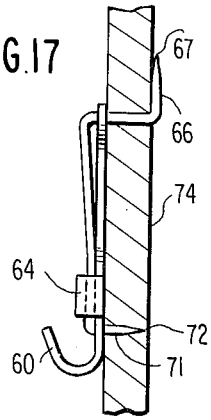
FIG. 17 is a side elevation, taken through a section of wall, showing the hanger of FIGS. 15 and 16 when installed.

The procedure for attaching the hanger to a wall is the same as with the previously described modification. The sharp pointed end 67 is first forcibly pushed through the wall panel from the front and the upright portion 66 is pushed through so as to lie against the rear side of the panel, with the load-supporting second section 68 resting in the horizontal passage in the panel thus resting. In the process of accomplishing this the plate 55, which initially must be held in a generally horizontal plane, has been swung downwardly to lie flat against the front of the wall and in so doing the third portion 69 of the rod is bent from its unstressed position, as shown in FIG. 16, to a flexed position, as shown in FIG. 17, with the result that continuous pressure will be exerted to hold the plate 55 against the wall indicated at 74 and assist in preventing vertical displacement.

It should also be noted that in the process of flexing the portion 69 the load-supporting portion 68 will move downwardly into the slot 63 in the upper margin to prevent relative lateral displacement of the wind portions 58 with respect to the rod portion 68. While this would allow the hanger to swing about the axis of portion 68 if the lower end portion 71 did not engage the wall 74 in the absence of some other restraint, if the end portion 71 is long enough to enter the wall no swinging motion will take place. A further factor to be considered in the configuration of the fastener rod is that if the angular relationship between portions 69 and 70 is such that the portions 66 and 68 lie entirely in front of the plate when unstressed, as in FIG. 16, the configuration of the upper margin 75 of the plate is immaterial. However, this causes excessive force to flex the portion 69 when attaching the hanger, or the thickness of the wall is such that a long load-supporting portion 68 is required, it will be necessary to limit at least one side of the upper margin 75 to an arcuate line which will allow the rod to swing about pivot opening 61 for attaching, and detaching, the fastening rod.

Figure 19:
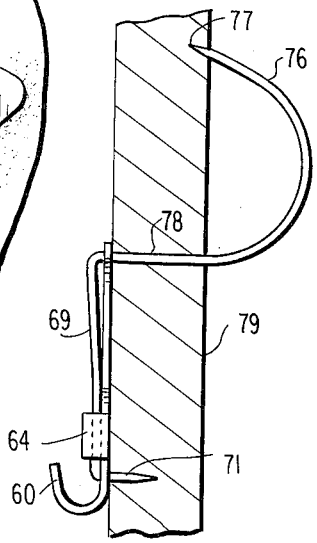
FIG. 19 is a side elevation taken through a section of wall, showing the fastener rod of FIG. 14 combined with the support member of FIG. 12.

In FIG. 14 a modified form of fastener rod 57 is shown for use in the case of thick wall panels such as wallboard or gypsum board. In this case, the first penetrating portion 76, provided with a sharp pointed end 77, is arcuately formed with a radius of curvature that will be large enough to allow the straight load-supporting portion 78 to be forced into the resulting opening produced in a thick wall 79, as shown in FIG. 19. As in a modification previously described, the curvature and length of the portion 76 should be such that the pointed end 77, when engaged with the back of wall 79, will flex the portion 76 to force the point 77 deeper into the back of the wall for added resistance to downward displacement and to press plate 55 against the front of the wall.

If it is desired to increase the holding power of either the hanger of the rear surface of the support member 25 of FIGS. 1–11, or support member 55, as shown in FIGS. 12–19 may be coated with an adhesive, such as a fluid-activated type, or one that is pressure sensitive; the adhesive in the latter case being temporarily protected by a removable cover sheet (not shown).

Figure 20:
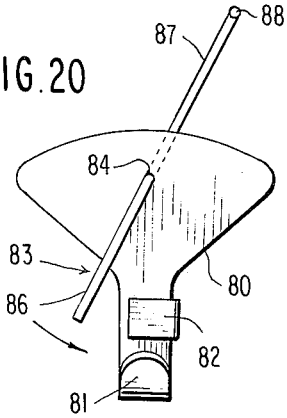
FIG. 20 is a front elevation of another modification illustrating the attachment of a separate penetrating fastener to the wall plate.
Figure 22:
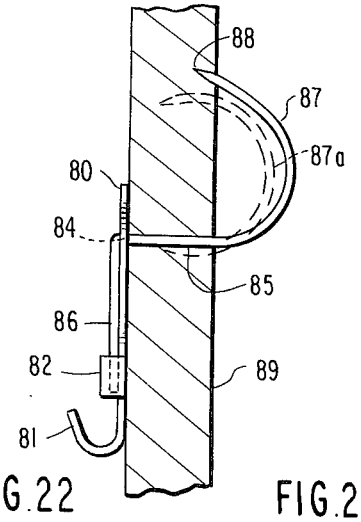
FIG. 22 is a vertical cross section through the wall of the installed hanger.
Figure 21:
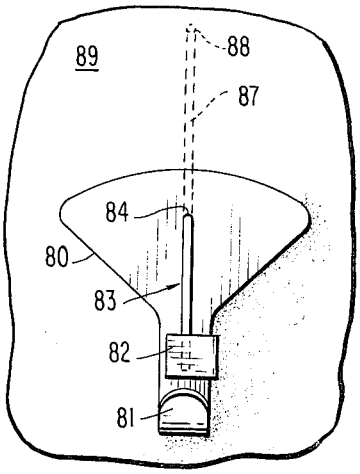
FIG. 21 is a front elevation of the hanger of FIG. 20 when installed.

A still further modification of the invention is shown in FIGS. 20–22 wherein a wall plate 80 has a configuration similar to that of the plate shown in FIG. 12–19, including an integrally formed load-supporting hook 81 and an overlapping clip 82 formed by bending back a portion of outwardly projecting margin. Instead of a recess in the upper margin to receive the fastening rod, indicated generally by numeral 83, a aperture 84 is provided in the upper middle of plate 80.

The reason for providing the opening 84 is that the fastener 83 is a separate element, not only for the purpose of convenience in packaging, but to allow the plate to be used even if the location selected happens to lie directly over a hidden stud behind the wall. In this case it would be useful to try to push the penetrating end of the fastener beyond the rear surface of the gypsum or wallboard, so that it is only necessary to discard the fastener completely and drive a nail through the aperture 84, the wall panel and into the supporting stud.

The fastener differs also in that it comprises only three basic segments and the springiness of the segment behind the wall is relied upon to press the plate 80 against the front of the wall. Thus, the fastener comprises a substantially straight medial load-supporting segment 85, a shank segment 86 depending downward generally at a right angle at the front end of segment 85, while the real end of medial segment 85 merges with the arcuately upwardly and backwardly turned penetrating segment 87 which terminates in a sharply pointed end 88.

When the fastener 83 is used it is first inserted from either end into the aperture 84 with the shank segment 86 lying over the front face of plate 80 and depending angularly downwardly at an angle to the left as shown in FIG. 20. The depending end 86 is then swung in a counterclockwise direction to a vertical position under the clip 82. The pointed tip 88 is then pressed against the wall at the desired location and the penetrating end 87 is forcibly pushed the wall 89 so that it turns upwardly behind the wall, as seen in FIGS. 21 and 22, with the medial segment 85 disposed generally horizontally in the passage in the wall panel made by the penetrating segment.

In this modification it should be noted that pressure to urge plate 80 into close contact with the front of the wall is applied by the upwardly directed penetrating segment 87 whose normal, unstressed shape is indicated by broken lines 87*a* in FIG. 22. While the passage of the medial segment 85 through the aperture 84 in plate 80 serves as the major support to prevent vertical downward displacement of the plate, the stressing of the arcuate segment 87 forces the tip 88 into the rear side of the wall panel which, not only prevents swinging movement of plate 80 from side to side, but also resists any vertical displacement and increases the load-supporting capacity of hook 81.

A further advantage of this modification lies in the fact the length and radius of the penetrating segment 87 can be so chosen that when in its unstressed condition the tip 88 lies in alignment with, or only slightly behind the plane of the plate 80. Therefore, while the fastener rod 83 is primarily designed for use with relatively thick gypsum board, it is adapted for use with thin plywood panelling or any intermediate size in between.

I claim:

1. In a wall hanger, the combination comprising: a supporting member having a generally flat rear surface and a front surface, said supporting member being adapted for abutting engagement with the front surface of a wall; a fastener rod member made of resilient wire shaped to form a succession of sections including: a penetrating section terminating in a tip adapted to penetrate a wall to introduce thereinto a succesive section; a load supporting section to be disposed generally horizontally in the wall, a flexural section having an upper and a lower end, said flexural section extending downwardly from said load supporting section in front of the front surface of the supporting member; a first means for connecting said flexural section to the front surface of the supporting member at a location spaced a predetermined distance below the load supporting section to resiliently bias the upper end of the flexural section away from the back surface of the supporting member; at least a portion of the penetrating section being in abutting contact with the rear side of the wall when the hanger is in place to resiliently bias said flexural section to press the generally flat rear surface of the supporting member against the front surface of the wall.

2. A wall hanger according to claim 1, wherein a second means for connecting is provided to secure said fastener rod to said support member at a location spaced from said first means for connecting to limit relative swinging movement of the fastener rod and support member about said first means for connecting.

3. A wall hanger according to claim 2, wherein said support member comprises a flat plate, the upper margin thereof being provided with a depending slot formed between a pair of side walls, the pair of side walls comprising said second means for securing.

4. A wall hanger according to claim 2, wherein said support member is provided with a horizontal aperture therethrough, and a section of said fastener rod extends through said aperture.

5. A wall hanger according to claim 1, wherein means for limiting swinging is provided to limit swinging movement of the support member with respect to a wall about an axis perpendicular to the wall when the fastener rod member is operatively mounted to the wall.

6. A wall hanger according to claim 5, wherein said generally flat rear surface of said support member has a surface which is provided with an adhesive coating for adhering said supporting member to the wall.

7. A wall hanger according to claim 5, wherein a rearwardly extending spike spaced from said load-supporting section is provided to be at least partially embedded in the wall.

8. A wall hanger according to claim 7, wherein said spike is attached to said support member.

9. A wall hanger according to claim 7, wherein said spike is attached to said fastener rod.

10. A wall hanger according to claim 9, wherein a transverse rod having both ends sharpened and extending in a rearward direction is attached to said fastener rod.

11. A wall hanger according to claim 10, wherein said sharpened ends extend through aligned openings in the support member.

12. A wall hanger according to claim 5, wherein the end of said fastener rod remote from said penetrating section is sharpened and extends rearwardly into the front of a wall.

13. A wall hanger according to claim 12, wherein said remote end of the fastener rod projects through an opening provided in the support member.

14. A wall hanger according to any one of claims 1, 2, 5, 7 or 13, wherein said penetrating section of the fastener rod is straight and projects upwardly in a plane parallel to a wall.

15. A wall hanger according to any one of claims 1, 2, 5, 7 or 13 wherein said penetrating section of the fastener rod is arcuate and only the terminal end thereof is in contact with a wall.

16. A wall hanger according to any one of claims 1, 2, 5, 7 or 13, wherein the end of the fastener rod remote from the penetrating section defines a forwardly projecting article-supporting hook.

17. A wall hanger according to any one of claims 1, 2, 5, 7 or 13, wherein said support member is provided with a slotted aperture extending generally at right angles to the direction of a force exerted by a supported article to receive a flat prong to be forcibly inserted into a wall to resist said force.

18. A wall hanger according to any one of claims 1, 2, 5, 7 or 13, wherein said support member includes an element for supporting an article and is provided with a pair of slots disposed on opposite sides of the supporting element and at right angles to a line extending from the supporting element to the center of a respective slot to receive respective flat prongs to be forcibly inserted into a wall to resist forces generated by a supported article.

19. A wall hanger according to any one of claims 1, 2, 5, 7 or 13, wherein said fastener rod is separable from the support member when the hanger is not in use.

20. A wall hanger according to claim 19, wherein said support member includes means for separably receiving a portion of the fastener rod remote from the penetrating section in an operative condition to prevent relative displacement of said received portion in a direction perpendicular to the plane of the flat surface of the support member.

21. A plate in combination with a separate spring wire fastener for forming a wall hanger to support an article upon a wall comprising a plate and a wire fastener, said plate having a front surface and a back surface, the wire fastener being resiliently deformable and having an angularly offset end portion adapted to be introduced through an opening in a wall and thereafter disposed in contact with the back side of the wall to exert a bending force on said another portion of the wire fastener disposed on the front side of the wall to urge the plate into close contact with the wall, said plate including means for separably attaching said spring wire fastener to the plate to permit resilient deformation of said another portion of the fastener;

said means for separably attaching said spring wire fastener comprising a clip integrally formed with said plate;

said plate having a margin, a projecting portion of the margin of said plate being reentrantly formed to overlie the front surface of the plate, said fastener being separably gripped between the clip and the front surface of the plate;

said plate including means for pivotally supporting one end of said fastener to permit swinging movement of said fastener between a first position for attachment and detachment of the fastener and a second position for retaining the fastener in place.

22. A combination according to claim 21, wherein said means for pivotally supporting an end of said fastener comprises an opening in said plate to receive one end of said wire fastener for relative movement therein.

23. A wire fastener rod made of springy resilient material for use with a support member having a flat surface to lie against the front surface of a wall to provide an article support, said rod being subdivided into at least four successively arranged portions, comprising:

a first portion to be disposed in contact with the back side of a wall terminating at one end of the rod in a pointed end adapted to penetrate said wall for forcibly introducing the rod into said wall; a second portion disposed at an angle to the first portion adapted to extend through the wall in a generally horizontally direction; a third portion disposed substantially at right angles to the second portion to extend across the exposed side of the support member and to be subjected to flexure by said contact between the first portion and said wall; a fourth portion adapted to be removably received by a means for mounting on the support member for fixedly positioning said fourth portion.

24. Fastener rod as defined in claim 23, wherein said rod also includes a fifth portion extending at an angle away from the fourth portion and terminating at the other end of the rod in a point adapted to be forcibly inserted into the front side of a wall.

25. Fastener rod as defined in claim 24, wherein said fifth portion extends generally in a horizontal direction through an aperture provided in the support member.

26. Fastener rod as defined in claim 25, wherein said fourth portion is disposed substantially at right angles to the fifth portion.

27. Fastener rod as defined in claim 26, wherein said aperture in the support member serves as a pivotal support for swinging movement of the rod in a plane parallel with the flat surface of the member between first and second positions and the support member includes retaining means adapted to permit said other end of the rod to enter into and be removed from said aperture when in said first position and to prevent said removal when in said second position.

28. A wall hanger for attachment to a wall and for supporting a load, comprising a flat load supporting plate provided with a wire fastener having a medial segment adapted to project generally horizontally through an aperture in the plate and through a wall; one end segment provided with a tapered wall penetrating tip, to project upwardly and backwardly behind the wall, and an other end segment; the other end segment being adapted to project downwardly when unstressed in close contact with the front surface of the plate; said tapered tip disposed when unstressed in a vertical plane substantially closer to the plane of said plate than in a deformed position when inserted in a wall, only said one end segment being deformed when the wall hanger is put in place to exerre to urge the plate and said wall penetrating tip into contact with front and back surfaces respectively, of a wall;

said wire fastener being separable from said plate, and further comprising means for connecting the wire fastener to the plate;

said means for connecting the wire fastener to the plate further including a clip fixedly attached to said plate;

said clip including an outwardly projecting marginal portion integral with said plate, the marginal portion being reentrantly turned to overlie the front surface of the plate;

said outwardly projecting marginal portion being disposed along a side margin of the plate whereby when said medial segment of the wire fastener is received in said aperture said other end segment is received in the open end of the clip by swinging movement of said wire fastener about said medial segment about said aperture as an axis.

* * * * *